US005250115A

United States Patent [19]

Faienza et al.

[11] Patent Number: 5,250,115

[45] Date of Patent: Oct. 5, 1993

[54] CONNECTOR PIN LUBRICANT APPLICATOR

[75] Inventors: Carlo M. Faienza; Wayne J. Zadrick, both of Bristol; Richard M. Speziale, Winchester, all of Conn.

[73] Assignee: United Technologies Corporation, Hartford, Conn.

[21] Appl. No.: 955,227

[22] Filed: Oct. 1, 1992

Related U.S. Application Data

[63] Continuation of Ser. No. 594,930, Oct. 10, 1990.

[51] Int. Cl.[5] ..... B05C 3/00

[52] U.S. Cl. ..... 118/429; 118/400; 118/428

[58] Field of Search ..... 118/429, 428, 400

[56] References Cited

U.S. PATENT DOCUMENTS 3,058,441 10/1962 Walker et al. ..... 118/429
4,204,498 5/1980 Ivancic ..... 118/428
4,997,359 3/1991 Lebrun ..... 118/429

FOREIGN PATENT DOCUMENTS 1123730 11/1984 U.S.S.R. ..... 118/400

*Primary Examiner*—W. Gary Jones
*Assistant Examiner*—Brenda Lamb
*Attorney, Agent, or Firm*—Patrick J. O'Shea

[57] ABSTRACT

A lubricant applicator system for electronic connector pins is designed to uniformly apply a lubricant to the pins to reduce the force necessary to install and extract a circuit board in the motherboard. The system includes a reservoir tank which supplies lubricant to a container into which electronic pins of an assembled connector are immersed, with holes disposed on the bottom surface of the container such that the lubricant enters the container via the holes and rises within the container to a certain height which is controlled by an elbow valve, thereby coating only a predetermined length of the electronic pins with lubricant.

8 Claims, 4 Drawing Sheets

CONNECTOR PIN LUBRICANT APPLICATOR

This application is a continuation of Ser. No. 07/594,930 filed Oct. 10, 1990.

TECHNICAL FIELD

This invention relates to lubricant applicators, and more particularly to a lubricant applicator for electronic connector pins.

BACKGROUND ART

Many electronic systems such as computers employ circuit boards with card-edge connectors and a "motherboard". The motherboard is a circuit board containing connectors which mate with the card-edge connectors, and also containing the interconnecting wires which run between the individual circuit boards in the system.

Typical electronic systems contain several circuit boards placed in a card cage containing guides along which each circuit board slides into the proper position for mating of the circuit board edge connector with the corresponding motherboard connector. Force is required to properly mate the circuit board with the motherboard in the card cage. This force is partially a function of how many pins are on the edge connector and the depth of each pin. Therefore as the number of pins increase, the amount of force to install and extract a circuit board into/from the card cage increases.

Through the advancement of connector technology circuit boards now typically contain approximately 80 pins per edge connector in a relatively small area. Therefore a substantial amount of force (e.g., 90 lbs) may be required to mate a circuit board connector with the motherboard connector. This force may be too great for the average individual to generate in order to install and extract the circuit board in the card cage. In addition, requirements of the Occupational Safety and Health Administration (OSHA) limit the force to 95 pounds that any one person can be asked to exert. The installation and extraction force must be reduced to a reasonable level where an individual person can more easily install and extract each circuit board.

Lubrication of the pins is one way to reduce the installation and extraction force. However once the unlubricated pins have been inserted into the connector upon assembly thereof, the lubricant has to be applied to the pins uniformly; that is, the lubricant should only be applied to a certain percentage of the pin height while avoiding lubricant contact with the connector edges and the inside of the connector. This prevents the lubricant from coming into contact with the circuit board and degrading the conformal coating on the board. It is this uniform application of the lubricant which has been heretofore difficult to achieve.

DISCLOSURE OF INVENTION

An object of the present invention is to provide a lubricant applicator for lubricating connector pins in a uniform manner while avoiding lubricant contact with the inside of the connector.

A further object of the present invention is to reduce the likelihood of the lubricant applicator operator coming into contact with the lubricant.

According to the present invention, a lubricant application system comprises a reservoir tank which supplies lubricant to a container into which electronic pins of an assembled connector are immersed, with holes disposed on the bottom surface of the container such that the lubricant enters the container via the holes and rises within the container to a certain height which is controlled by an elbow valve, thereby coating only a predetermined length of the electronic pins with lubricant.

These and other objects, features and advantages of the present invention will become more apparent in light of the following detailed description of a best mode embodiment thereof as illustrated in the accompanying drawing.

BEST MODE FOR CARRYING OUT THE INVENTION

Figure 1:
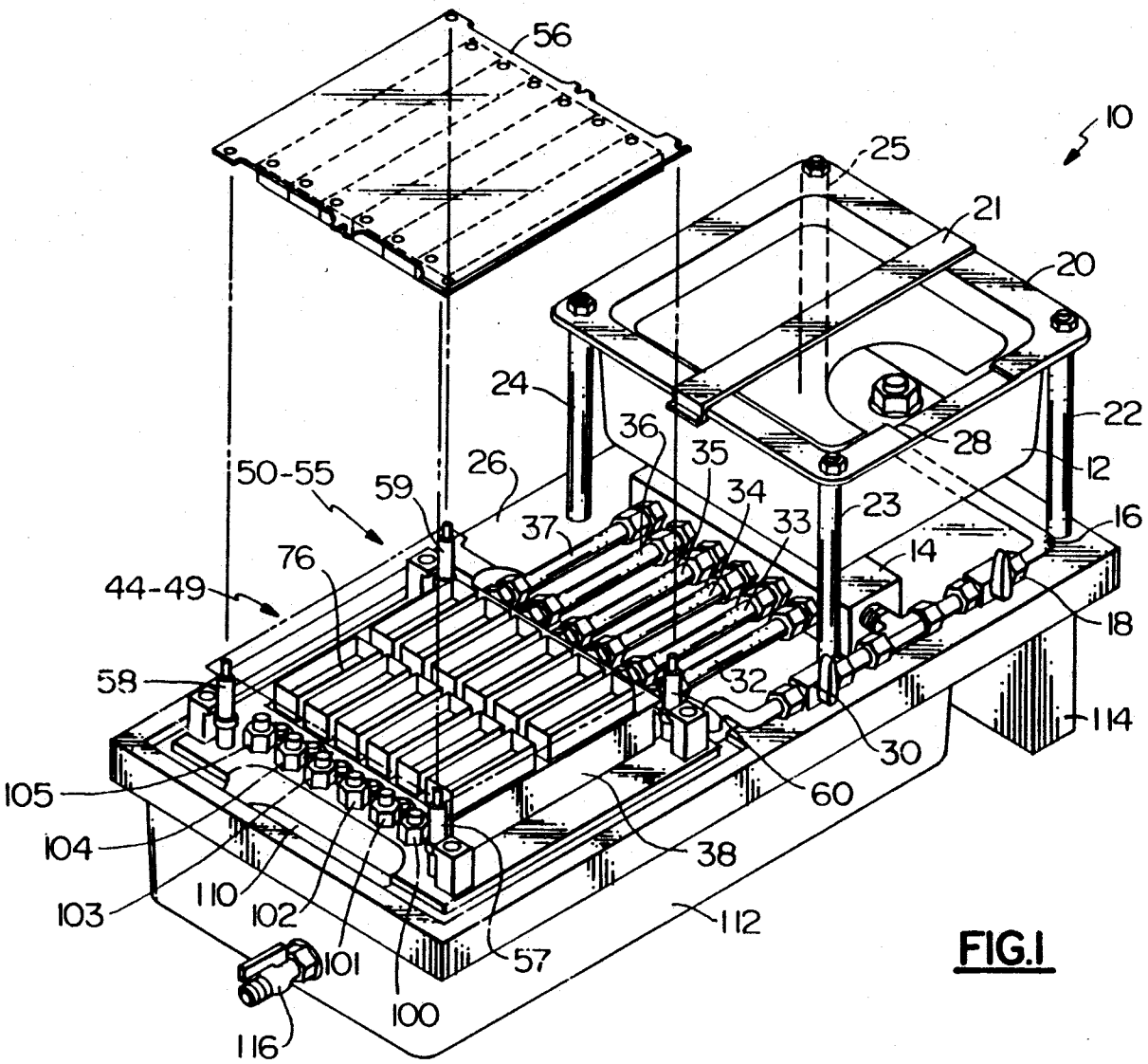
FIG. 1 illustrates the lubricant applicator system with the motherboard positioned above the system to illustrate how the motherboard is positioned on the system in accordance with the present invention.
Figure 2:
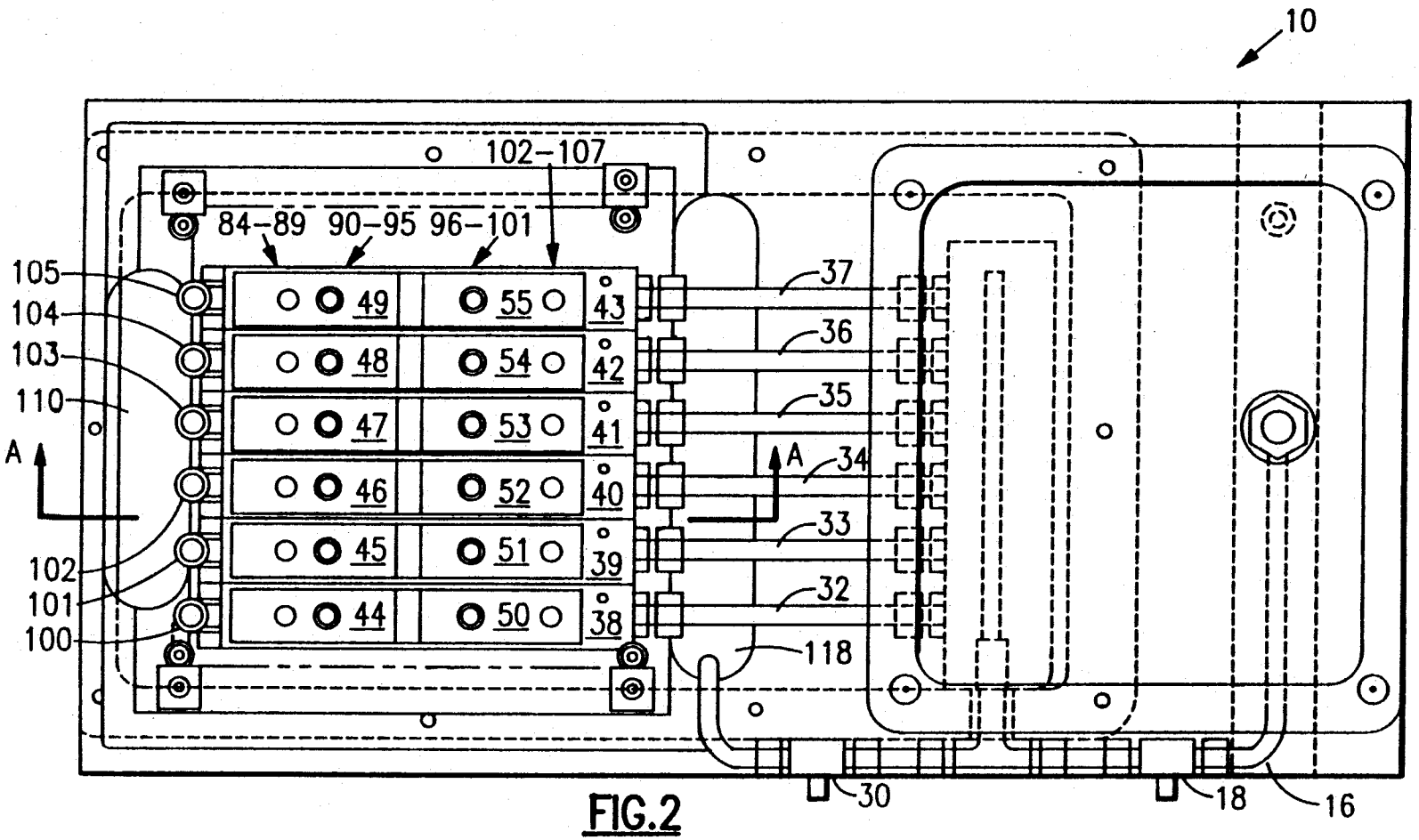
FIG. 2 illustrates a top view of the lubricant applicator system of FIG. 1 with the cover off of the reservoir tank.
Figure 3:
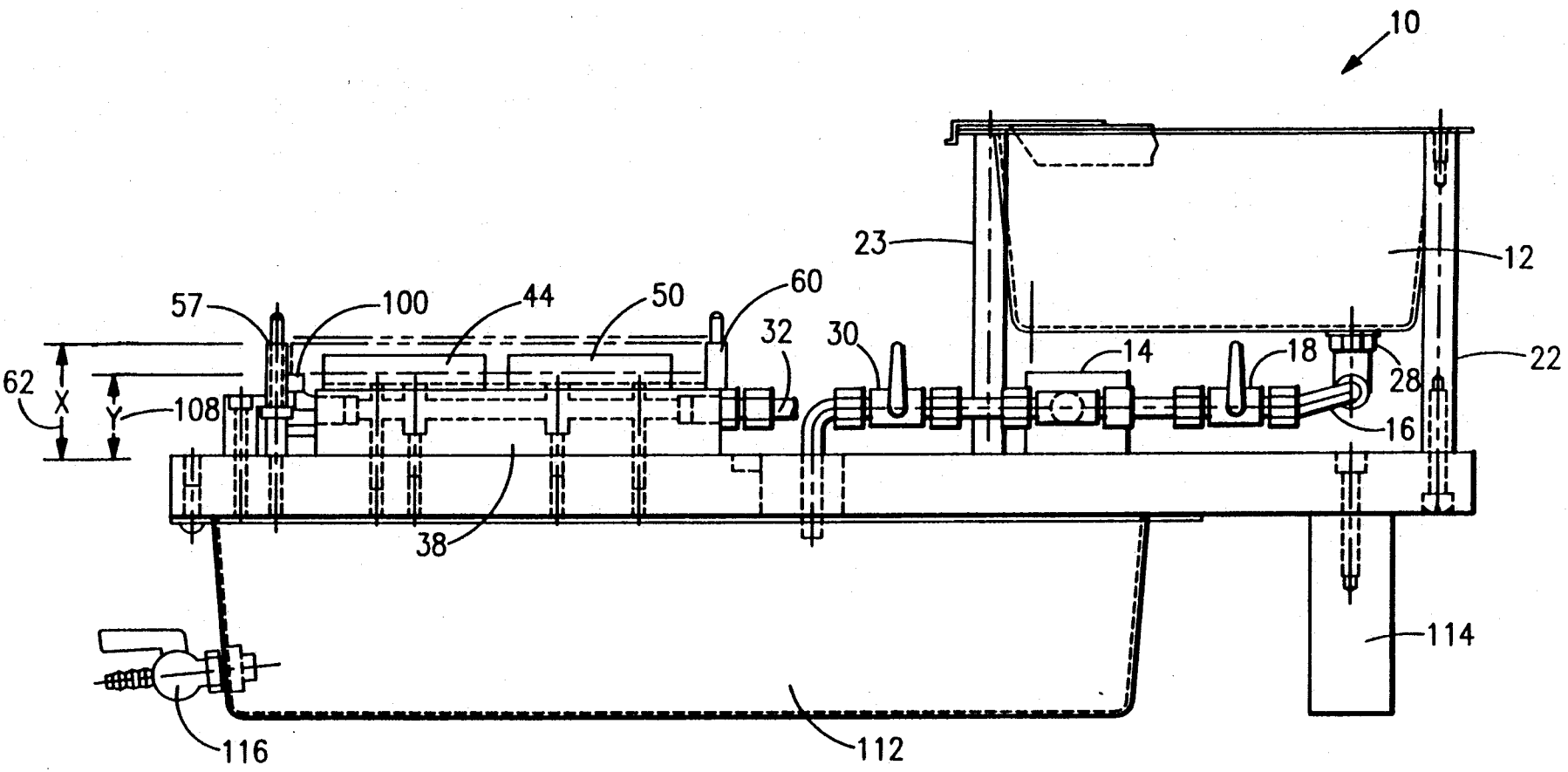
FIG. 3 illustrates a side view of the lubricant applicator system of FIG. 1 and FIG. 2.

Referring to FIGS. 1–3, a lubricant applicator system 10 (hereinafter "the system") is designed to supply a lubricant contained in a reservoir tank 12 to a manifold 14 via a first line 16 and a fill valve 18. An example of the lubricant is 2% Monsanto OS-138 (i.e., polyphenyl ether) with 98% of 1-1-1 trichloroethane and an ultraviolet trace. The reservoir tank 12 is made of stainless steel and is filled with lubricant by removing a cover 20 held in place by a retaining clip 21. The reservoir tank is supported by four vertical columns 22-25 of equal length fastened to both a main assembly 26 and the reservoir tank.

The lubricant is gravity fed from an exit port 28 of the tank into the first line 16, with the fill valve 18 controlling the amount of lubricant flow from the first line into the manifold 14. While the fill valve is open and a dump valve 30 is closed, the lubricant level in the manifold rises to the level necessary to initiate flow in six manifold outflow lines 32-37. Lubricant flow begins through all six manifold outflow lines at approximately the same time. Each manifold outflow line 32-37 enters and runs through a separate volume 38-43 as illustrated in FIG. 3 by the phantom lines associated with the first manifold outflow line 32 running through the first volume 38.

On top of the first volume 38 are securely mounted two well block containers 44,50. The second manifold outflow line 33 enters the second volume 39; on top of which securely mounted are two well block containers 45,51. The structure is similar for third, fourth, fifth and sixth volumes 40-43 and their associated manifold outflow lines 34-37 and well block containers 46-49,52-55.

Figure 4:
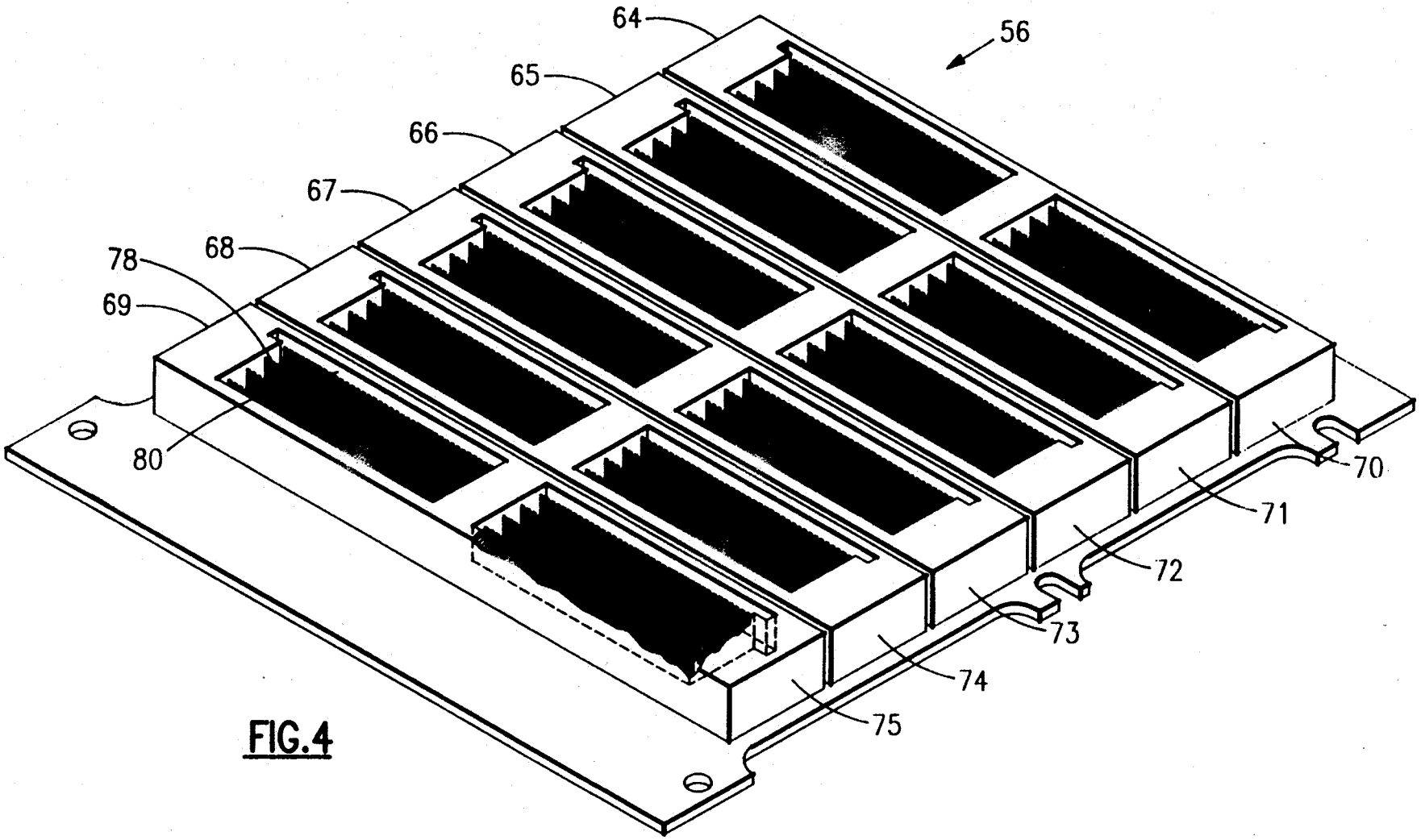
FIG. 4 illustrates the motherboard of FIG. 1.

Placement of the motherboard on the system may be understood by referring to FIG. 1, which illustrates a motherboard 56 positioned above the system in the interest of clarity. In actual operation the motherboard is positioned and held in place on the system by four part locating pins 57-60. FIG. 4 illustrates the motherboard 56 and how the connector pins are organized within twelve connectors 64-75 located on the motherboard. A height, x 62 (FIG. 3), is chosen for the part locating pins 57-60 to ensure the connector pins are immersed only a certain amount in the appropriate well block container such that only a predetermined pin length gets lubricated. Positioning the motherboard on the part locating pins 57-60, immerses the pins within connector 64 into well block container 44 which is located above volume 38. Similarly the pins within connector 75 are immersed in well block container 55 which is located above volume 43, and so on in a similar manner with respect to connectors 65-74.

Attention is drawn to the fact the system 10 is designed to position the motherboard on the part locating pins such that the vertical walls of each well block container are positioned between the outer row of pins and the inner surface of the associated connector. As an example a vertical wall 76 (FIG. 1) of well block container 49 is positioned between an outer row of pins 78 (FIG. 4) and an inner surface 80 of connector 69. Thus the only elements immersed in the well block containers are the connector pins, while the inner surface of each connector is safely positioned on the outside of the well block container walls separated from lubricant contact.

Within each volume 38-43 the lubricant flowing in the associated manifold outflow line 32-37 goes up through taps to the well block containers 44-55. Each well block container 44-55 contains two taps which terminate at holes 84-107 arranged in four columns as illustrated in FIG. 2, allowing lubricant flowing through the holes to accumulate in the well block containers. While the fill valve 18 is open and the dump valve 30 is closed, the level of the lubricant in each well block container rises. The operator monitors the lubricant level in the well block containers by visually monitoring six elbow valves 100-105. Height y 108 of the elbow valves (FIG. 3) is chosen such that the lubricant exits the elbow valves when the lubricant within the associated well block containers has reached a certain level. This ensures that each motherboard is lubricated by the system in a repeatable fashion, i.e., the pins of each unit have lubricant applied to the predetermined pin length each time. Since the system operates on a gravity feed from the reservoir tank to the manifold, the exit port 28 is positioned at a vertical height exceeding the vertical height associated with the certain level of lubricant within the well block containers.

Lubricant which exits the elbow valves enters a pan inlet 110 and is collected in a drain pan 112, which along with a support block 114 supports the main assembly 26. When the lubricant starts to exit the elbow valves 100-105 the operator closes the fill valve 18 to terminate lubricant flow from the first line 16 to the manifold 14. At this time the connector pins have been lubricated the predetermined pin length. Finally the lubricant within the drain pan 112 can then be drained back into a storage bottle (not shown) or a similar container via a drain valve 116 which the operator can open or close.

Having observed the details of the system 10, attention may now be given to an example of the system operating instructions. First ensure the fill valve, dump valve and drain valve are all in the closed position. Ensure the system is level and remove the cover to fill the reservoir to approximately 75% capacity with the lubricant and reinstall the cover. Place the motherboard assembly containing the motherboard connectors and pins on the four part locating pins. Open the fill valve to allow lubricant to flow into the manifold, the manifold outflow lines and the well block containers. When all the elbow valves have overflowed, close the fill valve to terminate the flow of lubricant through the fill valve. Open the dump valve to allow the lubricant in the well block containers, manifold outflow lines and the manifold along with the lubricant in the lines upstream of the dump valve to drain into the drain pan via a second pan inlet 118 (FIG. 2). Allow several minutes for the drainage. Remove the motherboard assembly from the part locating pins and visually inspect the connectors and pins under a black light (not shown) to ensure all the pins have been lubricated to the predetermined pin length and the lubricant has not come in contact with the inside of the connectors. (The ultraviolet trace within the lubricant facilitates this type of inspection.) The drain valve is then opened to empty the lubricant in the drain pan into a container (not shown) for eventual reuse in the system.

It should be understood that the scope of this invention is not limited to the specific embodiment illustrated in the drawing. As an example a microprocessor may be employed in the system to control the switching of the valves based on the level of lubricant in the well block container. Such a design may require the valves to incorporate electro-mechanical actuators to affect the movement of the valves. The invention is also not limited to a particular connector or motherboard design. Rather the apparatus of the present invention may be modified by primarily altering the well block container design and the part locating pins to suit the characteristics of the particular connector whose pins are being lubricated. Also a pump or similar means may be incorporated to recirculate the lubricant exiting the overflow valves back to the reservoir tank.

All the foregoing changes and variations are irrelevant to the invention, it suffices that connector pins are immersed into a container and lubricant is introduced into the container at the base of the container, and the level of lubricant rises in the container to a certain level thereby lubricating the connector pins a predetermined pin length while ensuring lubricant does not come in contact with the connector.

Although the present invention has been shown and described with respect to a best mode embodiment thereof, it should be understood by those skilled in the art that various other changes, omissions and additions to the form and detail thereof, may be made therein without departing from the spirit and scope of the invention.

We claim:

1. A lubricant applicator system for applying a lubricant to the pins of an electronic connector having a connector shell which surrounds the electrically conductive pins, the system comprising:

means for supplying the lubricant;

a valve having a variable flow area which receives lubricant from said means for supplying and controlling the amount of lubricant which flows through said variable flow area to provide a controlled flow of lubricant;

a manifold having a plurality of parallel outlets for receiving said controlled flow of lubricant and for directing said controlled flow to each of said plurality of parallel outlets;

a plurality of containers each operatively connected to receive lubricant from at least one of said plurality of parallel outlets, each of said containers having interconnected vertical walls disposed to contain said lubricant, wherein each of said containers includes at least one orifice on its bottom surface through which lubricant enters;

means for controlling the level of said lubricant within each of said containers such that only a predetermined length of the pins has said lubricant applied thereto; and means for positioning and holding the connector in place such that said interconnected vertical walls are positioned between the pins of the connector and an inner surface of the connector shell so only the pins of the connector have lubricant applied thereto while avoiding lubricant contact with the inner surface of the connector shell.

2. The system of claim 1, wherein said means for controlling further comprises a plurality of elbow valves wherein one said elbow valve is affixed to each of said containers, such that said elbow valve overflows with lubricant when the lubricant within said valve's associated said container reaches a predetermined level which lubricates said predetermined length of the pins.

3. The system of claim 2 wherein said means for supplying lubricant is positioned at a height above said manifold such that the lubricant is gravity fed into said manifold.

4. The system of claim 3 wherein one of said vertical walls of each of said plurality of containers includes an outlet to which said container's said elbow valve is affixed such that lubricant overflows said elbow valve when the lubricant within said valve's associated said container reaches said predetermined level.

5. The system of claim 4 further comprising a drain pan for capturing the lubricant that overflows from each of said elbow valves.

6. The system of claim 4 further comprising a plurality of fill manifolds each located beneath an associated one of said containers and each having an orifice on its top surface coaxial to its associated said container orifice, each of said plurality of fill manifolds receives lubricant from one of said parallel outlets such that when lubricant fills said fill manifolds the lubricant flows into said containers.

7. A lubricant applicator system for applying a lubricant onto electrically conductive pins surrounded by a connector shell of a mother board connector to reduce the force necessary to install and extract an electronic circuit board connector to and from the motherboard connector, the system comprising:

a reservoir tank which contains the lubricant and supplies the lubricant through an exit port;

a manifold having a plurality of parallel outlets which receive the lubricant from said exit port, said manifold for directing the flow of lubricant to each of said plurality of parallel outlets;

a plurality of containers, each having interconnected vertical walls disposed to contain the lubricant, wherein each of said containers includes at least one hole on its bottom surface through which lubricant from one of said plurality of parallel outlets flows into said container;

a plurality of elbow valves, each affixed to and operatively associated with only one of said plurality of containers, such that each said valve overflows with lubricant when the level of the lubricant within said valve's said associated container reaches a level necessary to lubricate a predetermined length of the pins; and means for positioning and holding the connector in place such that said vertical walls are positioned between the pins of the connector and an inner surface of the connector shell while avoiding lubricant contact with the inner surface of the connector shell.

8. The system of claim 7, further comprising a valve disposed between said reservoir tank and said manifold for controlling the flow of lubricant.

* * * * *